US005994634A

United States Patent [19]

Cady

[11] Patent Number: 5,994,634

[45] Date of Patent: Nov. 30, 1999

[54] ANCHORING DEVICES FOR PERCUSSION MUSICAL INSTRUMENTS

[76] Inventor: William C. Cady, 1050 Honeoye Falls Five Points Rd., Honeoye Falls, N.Y. 14472

[21] Appl. No.: 08/824,698

[22] Filed: Apr. 8, 1997

Related U.S. Application Data

[60] Provisional application No. 60/007,261, May 6, 1996.

[51] Int. Cl.[6] ..... G10D 13/07

[52] U.S. Cl. ..... 84/421

[58] Field of Search ..... 84/421, 453; 248/346.03, 248/346.06, 346.5

[56] References Cited

U.S. PATENT DOCUMENTS

| | | | |
|---|---|---|---|
| 133,520 | 12/1872 | Coles | 248/346.06 |
| 3,096,677 | 7/1963 | Ryan | 84/453 |
| 4,037,835 | 7/1977 | Forsyth | 248/346.5 |
| 4,441,398 | 4/1984 | Baker | 84/421 |

*Primary Examiner*—Robert E. Nappi
*Assistant Examiner*—Kim Lockett
*Attorney, Agent, or Firm*—Harris Beach & Wilcox, LLP.

[57] ABSTRACT

In order to enable the instruments of a percussive instrument assembly to be located where desired and to prevent the instruments from moving away from the player, anchoring devices are disposed in clamping relationship with a removable rug on which the instrument assembly is disposed. The devices have opposite edge surfaces one of which in concave and preferably has a notch or undercut. The devices are located were desired by the player through the rugs and receive the legs or other appendages of the percussive instruments thereby anchoring them permanently in place and preventing movement when the instruments are struck or are foot operated by foot pedals the operation of which results in forces pushing kick drums and cymbal assemblies (hi-hat) away from the player. The anchoring devices may be called "Drum Ruggers".

14 Claims, 2 Drawing Sheets

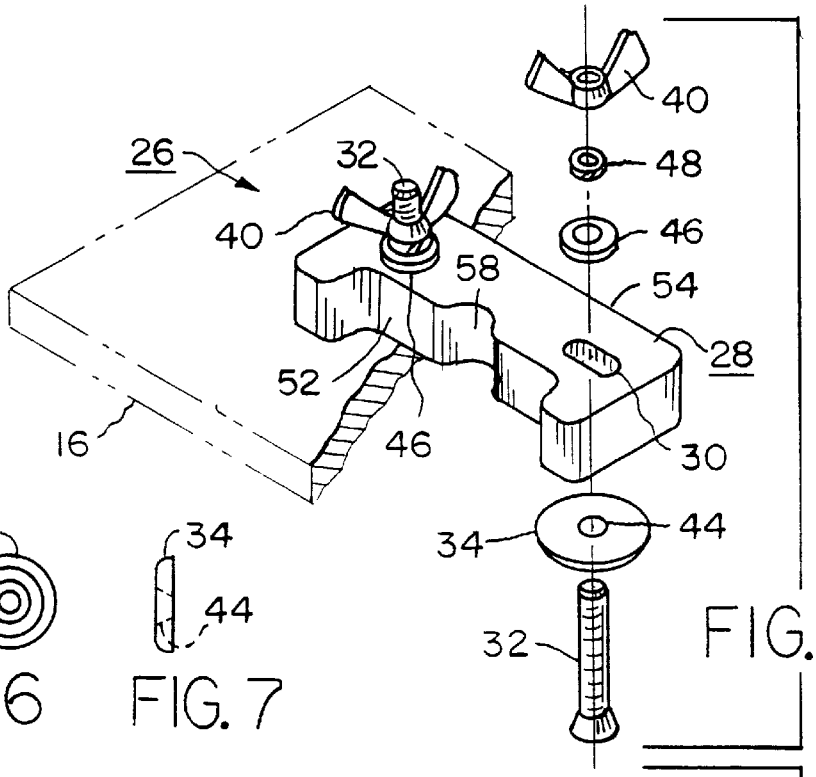
FIG. 5
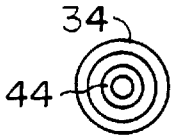
FIG. 6
FIG. 7
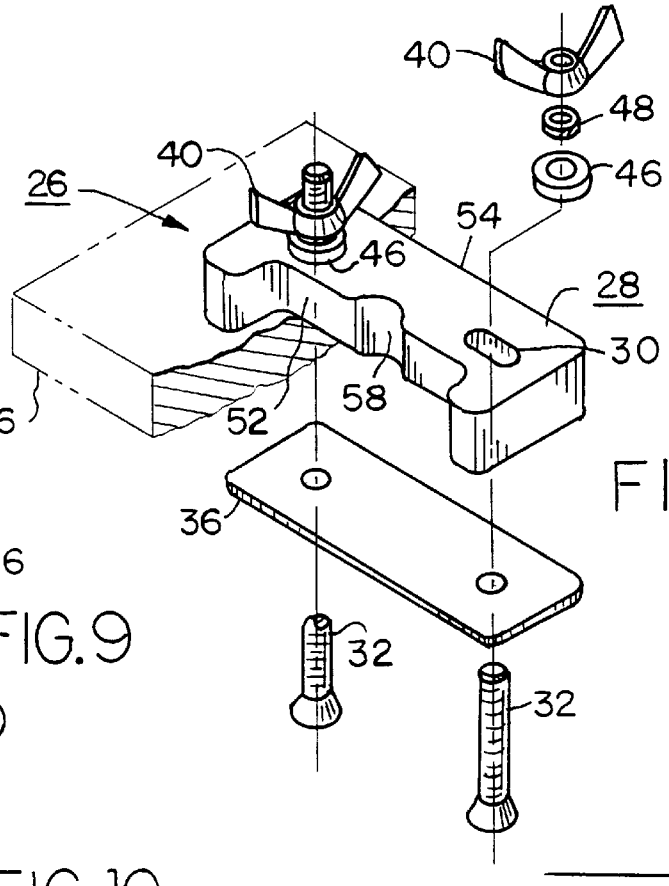
FIG. 8
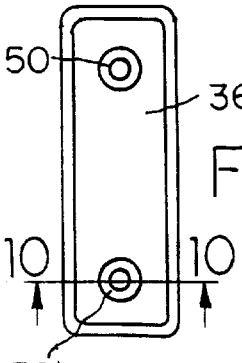
FIG. 9
FIG. 10

ANCHORING DEVICES FOR PERCUSSION MUSICAL INSTRUMENTS

DESCRIPTION

Priority is claimed to provisional application filed in the U.S. Patent and Trademark Office, May 6, 1996 and assigned application number 60/007,261. The applicant is William C. Cady. The title of the provisional application is Drum Ruggers.

The present invention relates to assemblies of percussive musical instruments which may be called drum sets and include drums, cymbals, kick drums and the legs or appendages by which they are supported in front of a player. The assemblies are characterized by devices which locate the instruments on a removable rug and anchor the instruments in place at the selected locations thereof. The invention provides anchoring devices which may be disposed in clamping relationship with the rug and have surfaces which constrain the appendages or legs of the instruments or actuators for operating the instrument, such as kick drum. The devices may be called "Drum Ruggers." The term rug should be taken to mean any base upon which the percussive instruments are assembled and may include stages and risers.

When percussive instruments are operated they tend to move away from the player. Drums and cymbal units, sometimes called high-hats, may be operated by foot pedals. The foot pedals are arranged at an angle to the floor and the resulting motion causes a force parallel to the floor and away from the player. The instruments therefore creep or travel away from the player. It is requisite to restrain the instruments against such motion and also to locate instruments where desired to meet the preferences of individual players. In other words, it is desirable to locate percussive or drum equipment universally. It is also desirable to get repeatability in set up so that the instruments may be located where desired by the player in spite of differences in the bandstands or other places which are made available for the drum equipment. It is also desirable that the anchoring devices be adapted to locate and anchor essentially all types of percussive instruments and the stands or racks on which they are supported, for example any of the following: cylindrical or square tube rack systems; bases of cymbal stands, including tri-fold legs with rubber feet; drum stools; conga stands; floor based electronic equipment; side stabilizer legs on kick drums; high-hat legs; snare stands; tom stands; Djembe stands; bongo stands; percussion tables; temple block stands; microphone stands; roto toms stands; xylophones; timpani drums; and steel drums.

Accordingly, it is an object of the present invention to provide improved assemblies of percussive instruments characterized in that they are located and anchored as and where desired by the players.

It is another object of the present invention to provide anchoring devices which are universally adapted for anchoring and locating essentially all percussive instruments and their stands or legs or supports.

It is a still further object of the present invention to provide improved anchoring devices for percussive musical instruments which may be assembled to the top of the players rug and enables the player to locate percussive equipment to meet individual playing requirements.

Briefly described, an assembly of percussive musical instruments embodying the invention includes drum, cymbals, and their stands, appendages or legs disposed on the top side of a removable rug. The assembly is characterized by anchoring devices which are disposed in clamping relationship as and where desired on the top surface of the rug. The devices have edge surfaces, at least one of which is concave, and may be provided by an indentation having a notch which receives the leg or appendage of an instrument in the assembly, locating the instrument and preventing it from moving when the instrument is played as by means of a kick drum which provides forces in the direction away from the player.

The foregoing and other features, objects that are advantages of the invention as well as presently preferred embodiments thereof will become more apparent from the reading of the following description in connection with the accompanying drawings in which:

FIG. 1 is a perspective view schematically illustrating a percussive instrument assembly (a drum set) having anchoring devices, all in accordance with the present invention;

FIGS. 2, 3, and 4 are top, right end elevational and bottom views, respectively of the body of the anchoring devices provided by the invention, which are shown in FIG. 1;

FIG. 5 is a perspective, exploded view illustrating an anchoring device embodying the invention having a ring shaped backing member for clamping the device to the players rug;

FIGS. 6 and 7 are top and elevational views of the ring shaped backing number, respectively;

FIG. 8 is a perspective explosed view illustrating an anchoring device embodying the invention having a plate backing members for clamping the device to the player's rug; and FIGS. 9 and 10 are top and end views of the backing members shown in FIG. 8.

Figure 1:
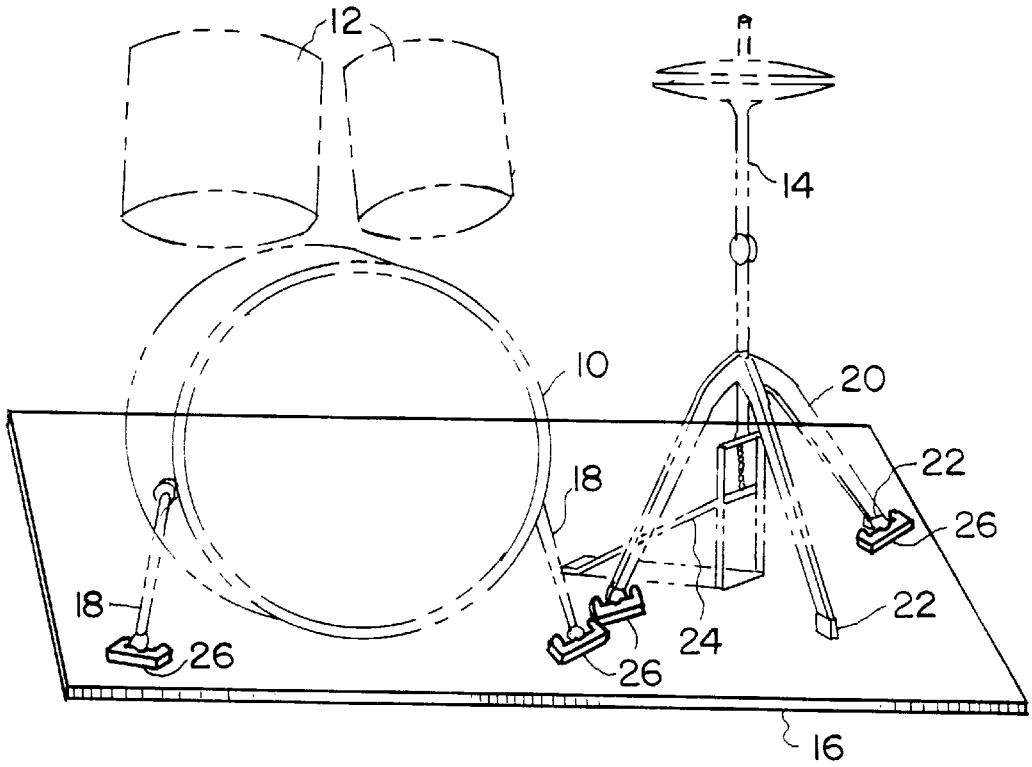
Figure 2:
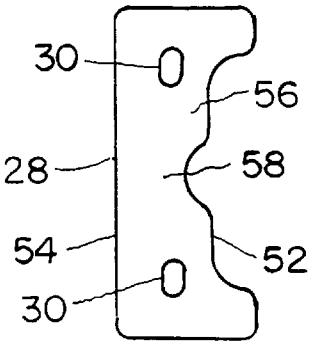
Figure 3:
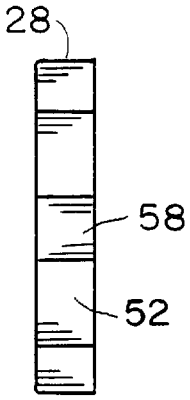

Referring to FIG. 1, there is shown a percussive instrument assembly or drum set having a base or kick drum 10, tom-toms 12, and a cymbal hi-hat unit and stand 14. The drum 10 is mounted along its drum barrel on a rug 16, which may be rolled up and carried with the set from place to place.

The drum is located by legs or appendages 18. The cymbal hi-hat 14 has a tripod leg stand having legs 20 with rubber feet 22. Such feet may also be on the ends of the legs 18. The cymbals are operated by a foot pedal 24. The drum 10 may also be operated by similar foot pedal. The players stool is behind the drum and cymbal. Accordingly, operation of the foot pedals and even percussion with the drum sticks on the cymbals or drums produces a component of force away from the player. This force is restrained by anchoring devices 26, which may be identical and which locate and anchor the legs 18 and 20 thereby preventing the percussive instruments from creeping or moving away from the player during operation.

Referring to FIGS. 2–10, there is shown the bodies 28 which are assembled to the top side of the rug 16 it will be noted that these bodies serve as center stops in front of the kick drum 10 and in front of the high-hat cymbal stand 14 these bodies are generally rectangular shape and have oblong or elliptical holes 30 which extend there through. Attachment means are provided screws 32 which extend through backing numbers 34 or 36. The attachment including the members 34, 36 put the anchoring devices 26 in clamped relationship with the rug 16. The clamping forces may be provided by wing nuts 40 which are threaded on the screws. In the event that the backing members are rings 34 shown in FIG. 5, two such rings are used and each has a hole 44 through which the screws 32 extend. Washers 46 and lock nuts 48 are also part of the attachment means. Holes 50 in the plate backing member 36, which are spaced from each other and are separated by distances approximately equal to the distances between the holes 30 in the body of the anchor device 26, also receive the screws 32 for purposes of attachment of the devices to the rug 16.

Figure 4:
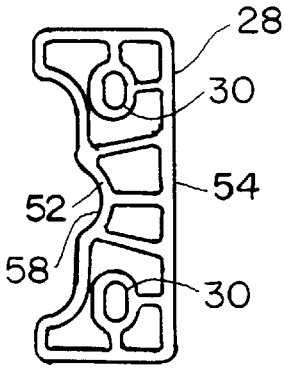

The bodies 28 may be molded of plastic with suitable reliefs as shown in FIG. 4 to reduce the amount of plastic material in the bodies 28.

The bodies 28 have longitudinal sides or edges 52 and 54 which define their lengths. One of these sides 52 is concave. The concave shape is provided by an indentation 56 having a notch 58. These concave indentations receive the legs of the percussive instruments and particularly their feet and prevents them from moving either longitudinally or laterally. The devices 26 therefore anchor the instruments, each in its own location as desired by the player. The player (the drummer) can have exactly the same set up every time he or she plays. The set up time is minimized because of the convenience and ease of assembling the anchoring devices to the player's rug.

As shown in FIGS. 5 and 8 the threaded screws 32 can have flat heads so that the heads are received into the backing member and prevent damage to the underlying floor, which may be desirable if the instruments are set up in a ballroom on a dance floor. The opposite edge 54 may also be used as a anchoring surface; for example against the rim or barrel of the base drum. The bodies 28 may have their concave surfaces of different shapes to conform with various styles of legs or appendages of percussive instruments. For example, the indentations may define rectangular areas,a triangular area, a trapezoidal areas, or various arcuate shapes. They may even define hooks or flanges.

The foregoing and other variations and modifications in the herein instrument described assembles, anchoring devices, within the scope of the invention will undoubtedly suggest themselves to those skilled in the art. Accordingly the foregoing description should be taken as illustrative and not in a limiting sense.

I claim:

1. A percussive musical instrument assembly which comprises a plurality of percussive instruments selected from the group consisting of drums, cymbals and kick drums each supportable by a appendages on a floor on the top of a removable rug and further comprising a plurality of anchoring devices having bodies having sides presenting opposites edge surfaces, at least one of which edge surfaces is at least partially concave, said devices being disposed on said top of said rug and each having an attachment which locates each of said devices selectively in removable clamping relationship with said rug, said devices are disposed against at least some of said appendages and blocking relationship therewith for opposing movement of said instruments as they are played.

2. The invention as set forth in claim 1 wherein said appendages are legs which are received by said bodies and are at least in part encompassed by the concave edge surfaces thereof.

3. The invention as set forth in claim 2 wherein said concave edge surfaces are provided in each of said bodies by an indentation along an edge of said body.

4. The invention as set forth in claim 3 wherein said indentation includes a notch extending from said concave surface thereof towards the side of said body opposite to side therof having said concave surface therein.

5. The invention as set forth in claim 1 wherein said anchoring devices are each generally rectangular in shape and have a length with said opposite sides defining the length thereof, and said concave surface defining one of said opposite sides.

6. The invention as set forth in claim 5 wherein said side having said concave surface provides an indentation, a notch in said indentation, said notch being intermediate the length of said side having said indentation therein.

7. The invention as set forth in claim 2 wherein said each of said bodies has holes extending through said body and said rug, and said attachment has means extending through said holes for providing said clamping relationship.

8. The invention as set forth in claim 7 wherein said attachment means further comprises at least one backing member on a bottom of said rug which is opposite said top side and opposing said body whereby to clamp said rug between said backing member and said body.

9. The invention as set forth in claim 2 wherein each of said bodies is essentially of moldable plastic material.

10. The invention as set forth in claim 8 wherein said attachment means further comprises a screw having a head disposed in said backing member and extending through a hole in said body, and a removable nut in threaded engagement with said screw and bearing against said body on a surface thereof facing away from said rug thereby enabling said nut to apply clamping forces to said body and said backing member.

11. An anchoring device for anchoring appendages which support and locate percussive instruments, said anchoring device comprising a body having top and bottom sides and said body having edges, attachment means for attaching said device as and where desired to a players rug with one of said edges defining a concave receptacle for one of said appendages thereby preventing movement of the instrument supported by said appendage while said instrument is being played.

12. The invention as set forth in claim 11 wherein said one edge is an indentation in said body which encompasses a foot at the bottom of said appendage.

13. The invention as set forth in claim 12 wherein said body is generally rectangular and has said edge defining said concave receptacle and an opposite edge, either of which can be disposed in blocking relationship with an appendage of said instrument or said instrument itself.

14. The invention as set forth in claim 12 wherein said attachment means comprises one or two backing members which are disposed on a side of said rug opposite to said body and having holes in alignment with corresponding holes in said body, and screws extending through said holes with nuts on said screws for applying clamping forces to said rug via said backing member and said body.

* * * * *